United States Patent [19]

Ohtake

[11] 4,174,546

[45] Nov. 20, 1979

[54] CONSTRUCTION FOR A WATER CLOSET

[76] Inventor: Toshiro Ohtake, No. 1-5, Tateishi 6-chome, Katsushika-ku, Tokyo, Japan

[21] Appl. No.: 854,314

[22] Filed: Nov. 23, 1977

[30] Foreign Application Priority Data

| | | | |
|---|---|---|---|
| Nov. 27, 1976 | [JP] | Japan | 51-143170 |
| Jan. 18, 1977 | [JP] | Japan | 52-004165 |
| Apr. 9, 1977 | [JP] | Japan | 52-095400 |

[51] Int. Cl.[2] ..... E03D 11/02; E03D 11/16; E03D 1/00

[52] U.S. Cl. ..... 4/420; 4/252 R; 4/300; 4/329; 4/DIG. 2; 4/DIG. 6

[58] Field of Search ..... 4/300, 1, 3, 329, 185 L, 4/185 S, 251, 254, DIG. 2, 420, 307, 312, 330–332, 428, 114, 114.1, 170, 144.3, 145, 252 R

[56] References Cited

U.S. PATENT DOCUMENTS

| | | | |
|---|---|---|---|
| 580,329 | 4/1897 | Rees | 4/144.3 |
| 1,683,430 | 9/1928 | Wright | 4/185 L |
| 1,982,245 | 11/1934 | Feulner | 4/185 L |
| 2,021,145 | 11/1935 | Dyar | 4/170 X |
| 3,914,806 | 10/1974 | Pearce | 4/185 L X |
| 3,925,833 | 12/1975 | Hunter | 4/185 L X |
| 4,028,751 | 6/1977 | Moran | 4/185 L X |
| 4,034,426 | 7/1977 | Hardwick et al. | 4/185 L |
| 4,058,859 | 11/1977 | Arrowood | 4/252 R |
| 4,091,473 | 5/1978 | Matthews et al. | 4/420 |

FOREIGN PATENT DOCUMENTS

| | | | |
|---|---|---|---|
| 882798 | 11/1961 | United Kingdom | 4/145 |

*Primary Examiner*—Stuart S. Levy
*Attorney, Agent, or Firm*—McGlew and Tuttle

[57] ABSTRACT

A water closet, comprising a floor, a movable stool disposed above the floor and mounted for vertical displacement above the floor and a drive apparatus connected to the stool for moving the stool to a selected height above the floor. The drive apparatus may include a drum connected to the stool and vertically movable in a hole in the floor. The stool may further be provided with a seat having two facing arcuate portions slidable on the stool and a pair of base rods connected to each arcuate portion extending at an angle downwardly toward the floor and through respective guides so as to adjust the spacing between the arcuate portions and resulting width of the seat with the vertical movement of the stool above the floor.

6 Claims, 13 Drawing Figures

CONSTRUCTION FOR A WATER CLOSET

FIELD AND BACKGROUND OF THE INVENTION

This invention relates in general to a toilet or water closet and, in particular, to a new and useful toilet or water closet having a stool which can be freely adjusted to any desired height according to the physical conditions of the person who is going to use the facility, such as, for example, when it is to be used by an adult, child, invalid or physically handicapped person.

DESCRIPTION OF THE PRIOR ART

In general, existing toilet or water closets are of the fixed height, stool-type which normally present difficulty to small children attempting to use the toilet by themselves. Such a construction also presents disadvantages to an invalid or a physically handicapped person who invariably must take an unnatural and, therefore, fatiguing position when seated. Such a construction also presents an uneasy feeling to a person who prefers the use of a Japanese style water closet in which one takes a crouching posture. In addition, the closet set thereof is of the so-called adult size and is too wide for children, resulting in frequent accidents and soiling of the floor.

SUMMARY OF THE INVENTION

The present invention comprises a construction which eliminates the above-noted disadvantages of the prior art constructions.

An object of the present invention is to provide a water closet having a stool the height of which can be adjusted by the use of a stool-height adjusting device.

Another object of the present invention is to provide a water closet having a stool with a closet seat, the width of which can be changed according to the adjusted height of the stool.

According to the present invention, there is provided a water closet, having a floor with a hole therein. A movable stool is disposed over the hole and a drum is formed integrally with the stool and extends vertically downwardly through the hole. A drum height adjusting means is connected to the drum for vertically moving the stool in relationship to the floor.

According to one aspect of the present invention, the drum height adjusting means includes guide wheels connected to the floor adjacent the hole which are in contact with the periphery of the drum for facilitating the smooth, vertical movement of the drum. A vertical screw rod is provided in the vicinity of the drum and threaded into a nut fixed to one end of the stool. The screw rod is fixed to the floor by suitable means and is provided with a bevel gear. A driving mechanism is provided for rotating the screw rod through the bevel gear and thus adjusting the height of the stool above the floor.

In accordance with another feature of the invention, th drum height adjusting means preferably comprises a pair of vertical racks provided on the opposite peripheral surfaces of the drum, a pair of shafts mounted to the floor adjacent respective vertical racks, a pinion connected to each shaft and engaged into each respective vertical rack, a crossed belt operatively connected between the two shafts and a driving mechanism adapted to rotate one of the shafts in one direction and which rotates the other shaft in the opposite direction through the crossed belt to raise or lower the stool above the floor. The driving mechanism may further include a first pulley connected to one of the shafts, a second pulley mounted for rotation at a position adjacent the stool, a hand wheel connected to the second pulley and an open belt wrapped about the first and second pulleys so that the stool may be raised and lowered by rotating the hand wheel which in turn rotates the two shafts with their pinions engaged to the respective vertical racks on the drum.

According to a further aspect of the present invention, the above drum is an inner cylinder of the enclosed double-walled type which is closely fitted into an outer cylinder of similar construction provided under the floor. The inner and outer cylinders are filled with oil and movable in relationship to each other by hydraulic valving means.

In another embodiment of the invention, an inner cylinder is vertically movable within an outer cylinder which is provided under the floor. The inner cylinder includes the stool which can be positioned at a desired height above the floor. The outer cylinder includes a peripheral flange extending outwardly from the upper edge of the cylinder and aligned over the border of the hole in the floor. In this way, the outer cylinder is supported at its upper edge in the vicinity of the hole and extends vertically downwardly from the level of the floor. The outer cylinder can be fixed to the floor by suitable means, such as, screws or bolts connected to the flange into the floor. Either the inner or the outer cylinder may include a pair of longitudinal slots or elongated holes on opposite sides thereof which are provided with internal substantially vertical racks of identical pitch.

A pair of pinions are mounted on a rotatable horizontal shaft and they are adapted to mesh with the internal racks of the slots. The pinions and horizontal shafts may be provided either in the outer or inner cylinder which does not include the elongated slots. A driving mechanism for rotating the pinions can be provided which includes a manual hand wheel connected to a vertical shaft running alongside the vertical cylinders and ending in a bevel gear which is engaged with a bevel gear connected to one end of the horizontal shaft.

In yet another embodiment of the invention, the drum may comprise an air cylinder with an air supply or compressor and an air-extracting vacuum pump connected thereto for providing the vertical movement of the stool. In this embodiment, a plurality of stools may be operated independently from one another by the use of a set or single compressor and vacuum pump connected thereto.

In a still further embodiment of the invention, at least one pair of base rods are slidably mounted at an angle in the floor adjacent opposite sides of the stool. The stool includes a seat having two facing arcuate portions which are slidably mounted on the upper surface of the stool. Each arcuate portion is connected to at least one base rod on respective sides of the stool and the spacing between the arcuate portions is adjusted with the raising or lowering of the stool to provide a seat of varying width complementing the height of the stool.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Embodiments of the present invention will be hereinafter described with similar numerals designating similar parts.

Figure 1:
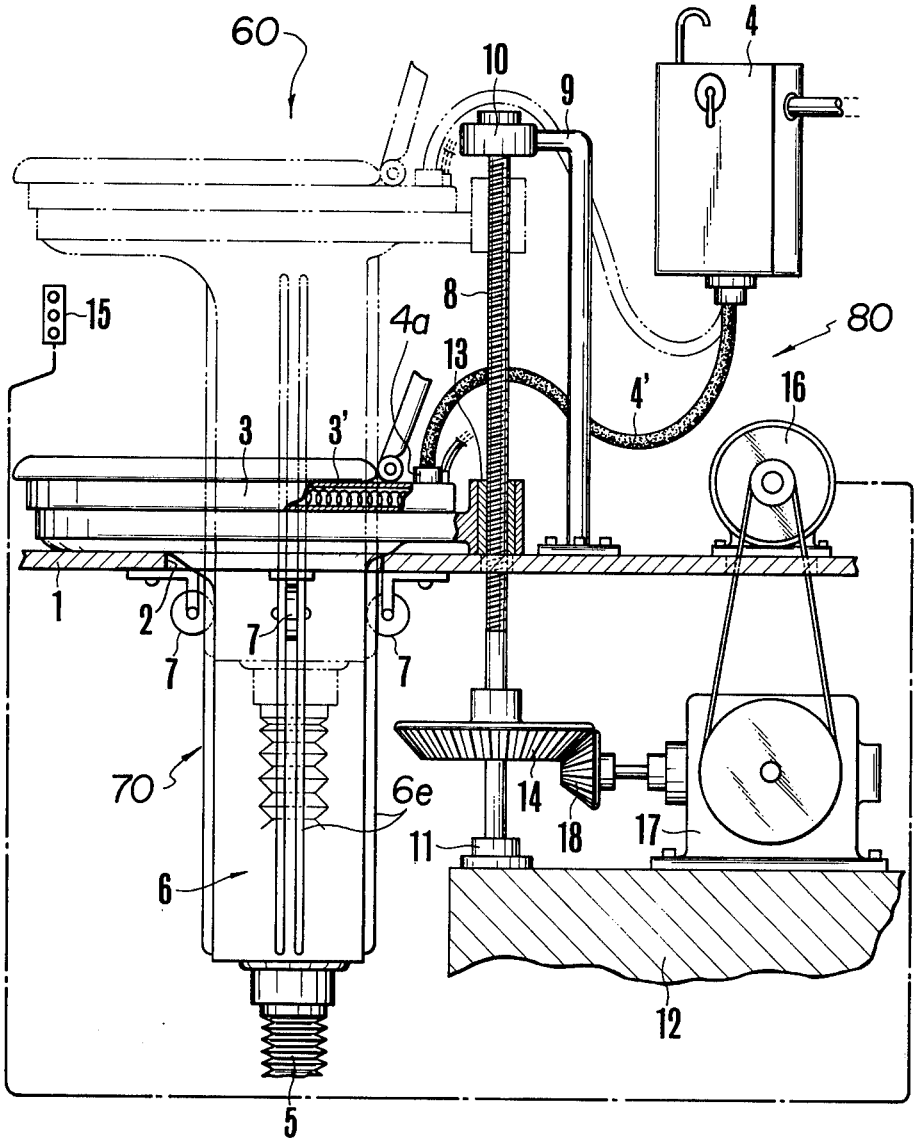
FIG. 1 is a partially in section side view of a water closet constructed in accordance with the invention.

With reference to FIG. 1, a toilet for human waste, generally designated 60, has a floor or support member 1 provided with a hole or guide opening 2. A stool member, generally designated 70, includes a stool or seat portion 3, which is equipped with a heater 3'. The stool member 70 includes a drum or tubular member 6 for vertical movement in the hole 2. A flexible flush pipe 4' extends from a water tank 4 to a water inlet **4*a* of the stool 3 to form a water tank connection to the stool member. A bellows-type scupper pipe 5 is connected to a scupper of the stool 3 and forms part of an opening through which waste may pass. The drum 6 extends vertically from the bottom of the stool 3 and is integral therewith. A mounting means for the stool member 70 includes two pairs of guide wheels 7 provided under floor 1 along the edge of hole 2 so that they bear against and laterally support the drum 6 at channels 6*e* to facilitate the smooth vertical movement of stool 3. A drive means 80 for moving the stool member 70 upwardly and downwardly includes a vertically rotatable screw rod or spindle 8 which is provided alongside of stool 3. Screw rod 8 is supported by a rotating means at its upper end by floor 1 through a stay 9 and a bearing 10 and, at its lower end, by a stand 12 through a bearing 11. The rotary screw rod 8 is threaded into a nut 13 which is fixed to the rear end of the stool 3. A bevel gear 14 is connected near the bottom of rotating screw rod 8. Bevel gear 14 is engaged with a bevel gear 18 and is rotated by a motor 16 through a reduction gear 17. The operation of motor 16 is controlled by a switch 15 which can be disposed near the stool 3. Stool 3 is adjusted to a desired level or height by operating the switch 15 to rotate the motor 16, reduction gear 17, bevel gears 18 and 14 and rotating screw rod 8** either clockwise or counterclockwise.

Figure 2:
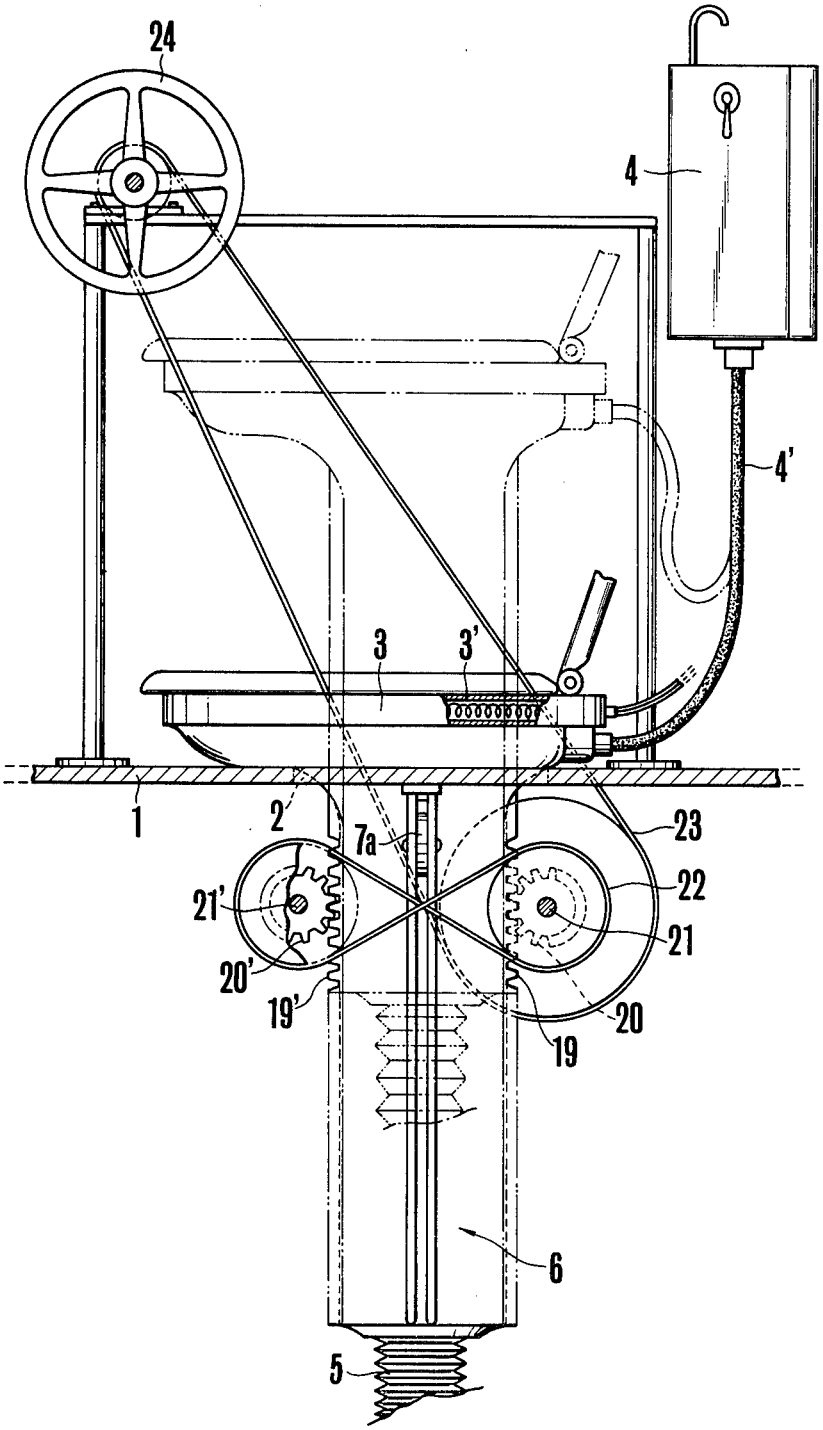
FIG. 2 is a partial sectional side view of another embodiment of the invention.
Figure 3:
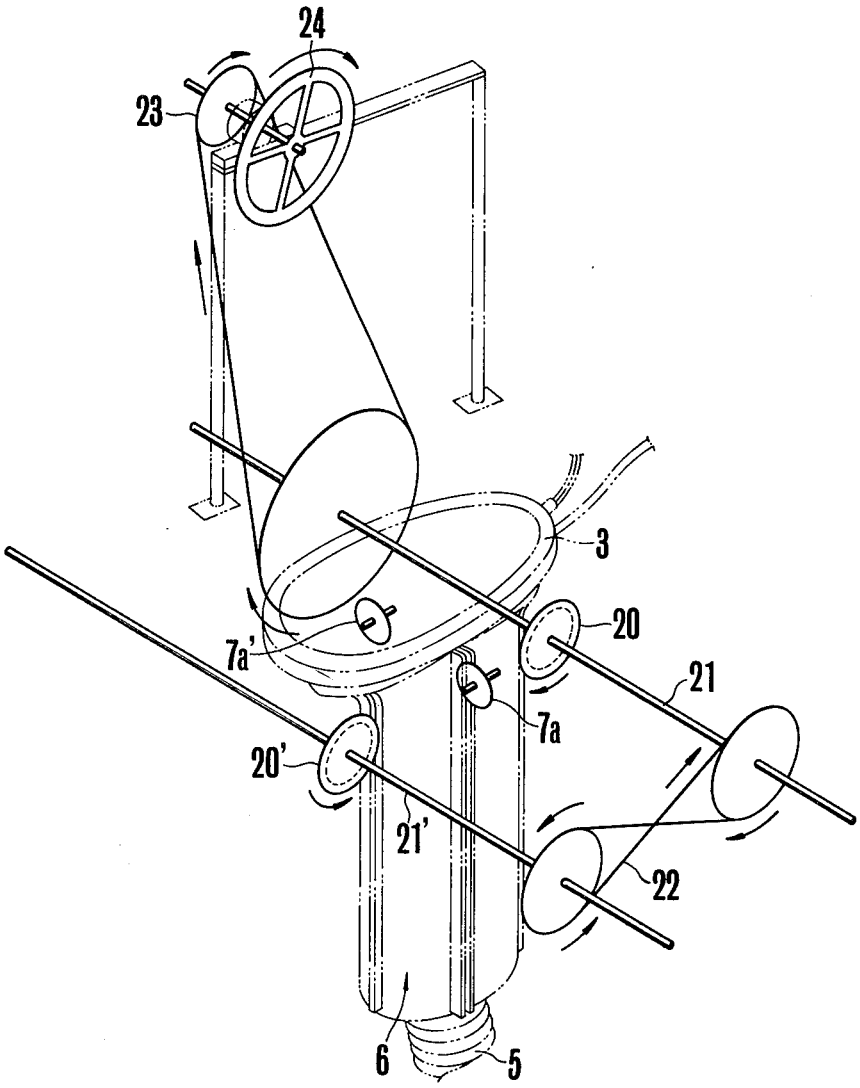
FIG. 3 is a perspective explanatory view of the operation of the embodiment shown in FIG. 2.

Another embodiment of the present invention is shown in FIGS. 2 and 3. Referring to these Figures, the toilet has a floor or support member 1 with a hole 2 therein, over which a stool 3 with a heater 3' is vertically movable. A flush pipe 4' extends from a water tank 4 to the water inlet of the stool 3. A bellows-type scupper pipe 5 is connected to the scupper of the stool 3. A vertical drum 6 is connected to the bottom of stool 3 and forms an integral part thereof. A pair of guide wheels **7*a* and 7*a'* are provided under floor 1 along the edge of the hole 2 so that they bear against and laterally support drum 6 to facilitate the smooth vertical movement of stool 3. A pair of racks 19 and 19' are provided along vertical sides of the drum 6 and mesh with pinions 20 and 20', respectively. Pinions 20 and 20' are connected to a crossed-belt means which includes a pair of shafts 21 and 21'. Shafts 21 and 21' are operatively connected to each other by crossed-belt and pulley arrangement 22 in order to reverse the rotational direction of one shaft with respect to the other. An open belt device 23 which is rotated by a manual hand wheel 24 is fixed to shaft 21**.

In operation, stool 3 is adjusted to a desired level or height by rotating the manual hand wheel 24 which in turn rotates the shaft 21 through belt 23. Pinion 20 then acts on rack 19 and pinion 20', through belt 22, acts on rack 19' to raise or lower drum 6 and stool 3.

Figure 4:
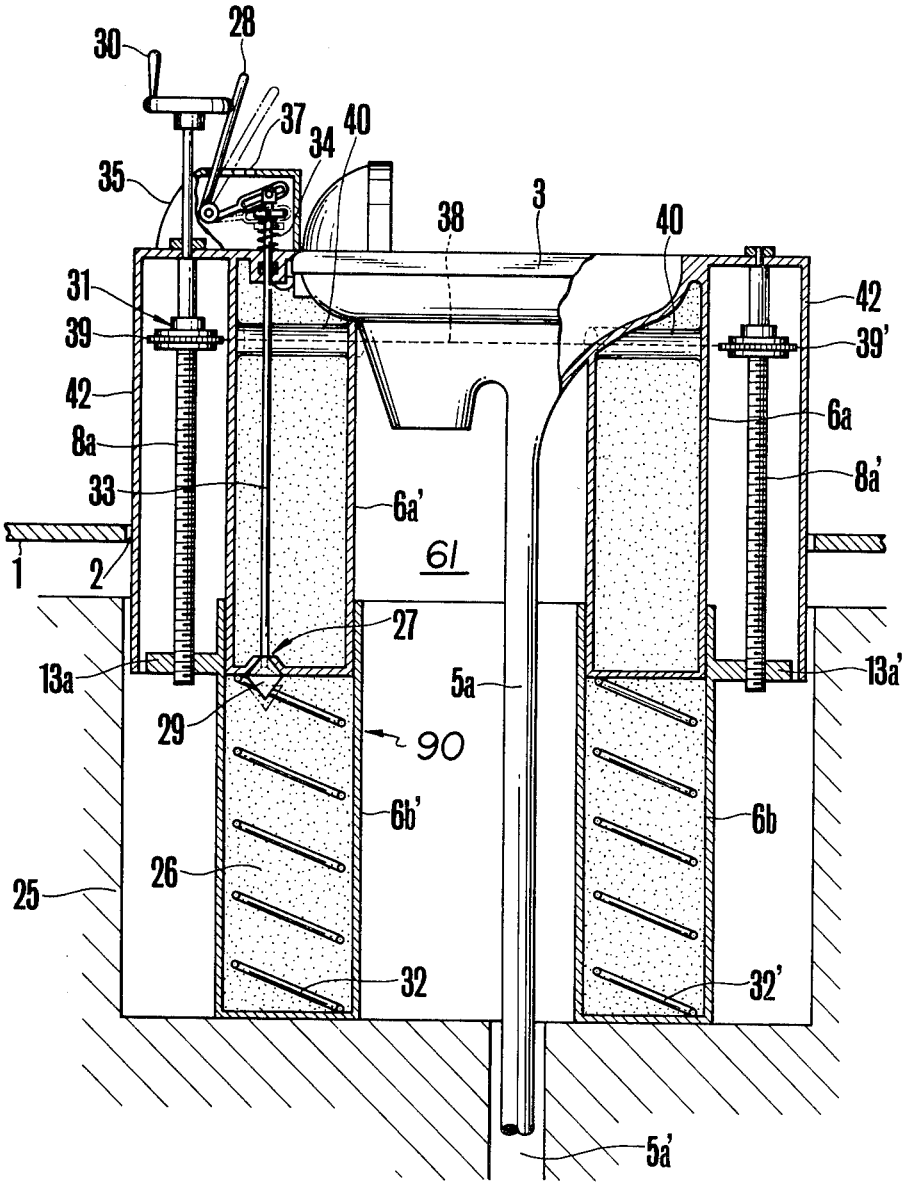
FIG. 4 is a partial sectional side view of another embodiment of the invention.
Figure 5:
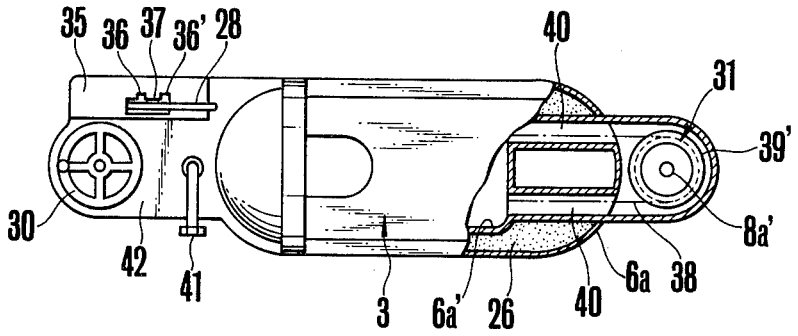
FIG. 5 is a partial sectional view of the water closet shown in FIG. 4.

Another embodiment of the present invention is described with reference to FIGS. 4 and 5. In FIGS. 4 and 5, the toilet includes a floor 1 with a hole 2. Mounting means 90 include a double-walled drum **6*a* which has an inner wall 6*a'* forming an inner space 61 in the center of drum 6*a* through which a scupper pipe 5*a* is passed. Double-walled drum 6*a* forms an inner cylinder and is provided vertically at the bottom of stool 3 integrally therewith. A double-walled drum 6*b* with an open top and closed bottom has an inner wall 6*b'* similar to the above-mentioned inner wall 6*a'* and it is provided on an under-the-floor platform 25. Drum 6*b* acts as an outer cylinder for receiving the double-walled drum 6*a*. The inner double-walled drum 6*a* is vertically movable and closely fitted in the outer double-walled drum 6*b*. The outer and inner double-walled drums 6*b* and 6*a* are filled with oil 26 having a selected viscosity. The bottom wall of the inner double-walled drum 6*a* has an oil passage 27 open to the inside of the outer double-walled drum 6*b***.

A valve ball 29 is provided in the oil passage 27 which opens and closes the passage 27 by the action of a lever 28. A pair of screw rods **8*a* and 8*a'* are provided at the front and rear sides of the inner double-walled drum 6*a*, which are rotated by a rotary handle or hand wheel 30 and are synchronized by a chain gearing means 31. Screw rods 8*a* and 8*a'* are threaded into nut sections 13*a* and 13*a'* which are fixed to the upper parts of the front and rear sides of the outer double-walled drum 6*b***, respectively.

Reference numerals 32 and 32' designate biasing means or springs for supporting the weight of the inner double-walled drum **6*a*, thereby, negating the weight of drum 6*a* on the screw rods 8*a* and 8*a'*. 33 designates a link for connecting lever 28 to a valve ball 29. 34 designates a spring for restoring the valve ball 29 to the closed position and for restoring the lever 28 to the non-operational position. A cover 35, having a guide groove 37, with stop notches 36 and 36' is disposed over the linkage to lever 28. A chain 38 is engaged with sprockets 39 and 39' disposed on opposite lateral ends of the stool 3. A passage 40 is provided through the inner double-walled drum 6a to allow the passage of the chain 38. A water inlet 41 is provided and a scupper pipe 5a extends through a scupper 5a'. Numeral 42 designates a cover for screw rods 8a and 8a'**.

In operation, when the top surface of stool 3 is to be lowered, lever 28 is tilted clockwise, as seen in FIG. 4, to move link 33 and ball 29 downwardly. Lever 28 can be engaged into notches 36 and 36' alternatively, thereby, bringing valve ball 29 into the open position. Oil 26 from the outer and inner double-walled drums 6b and 6a can thus flow from one drum to the other through the oil passage 27. If rotary handle 30 is then rotated, and screw rods 8a and 8a' are synchronously rotated through the chain gearing 31. The bottom parts of screw rods 8a and 8a' are consequently threaded downwardly through nut sections 13a and 13a', respectively, and thereby, the inner double-walled drum 6a is lowered.

When the top surface of stool 3 is lowered to a desired level, lever 28 is disengaged from the stop notch 36 or 36' and, thereby, lever 28, link 33 and valve ball 29 are returned to the original positions by the action of spring 34 and, as a result, oil passage 27 resumes the closed state. On the other hand, when the top surface of stool 3 is to be lifted, lever 28 is tilted in the same manner as mentioned above to bring valve ball 29 into the open state. It thus becomes possible to move oil 26 from inner double-walled drum 6a to outer double-walled drum 6b. If the rotary handle is then rotated, the screw rods 8a and 8a' will elevate inner double-walled drum 6a. When the top surface of stool 3 thus reaches the desired level, lever 28 is disengaged from stop notches 36 or 36' in the same manner as mentioned above to close oil passage 27.

Figure 6:
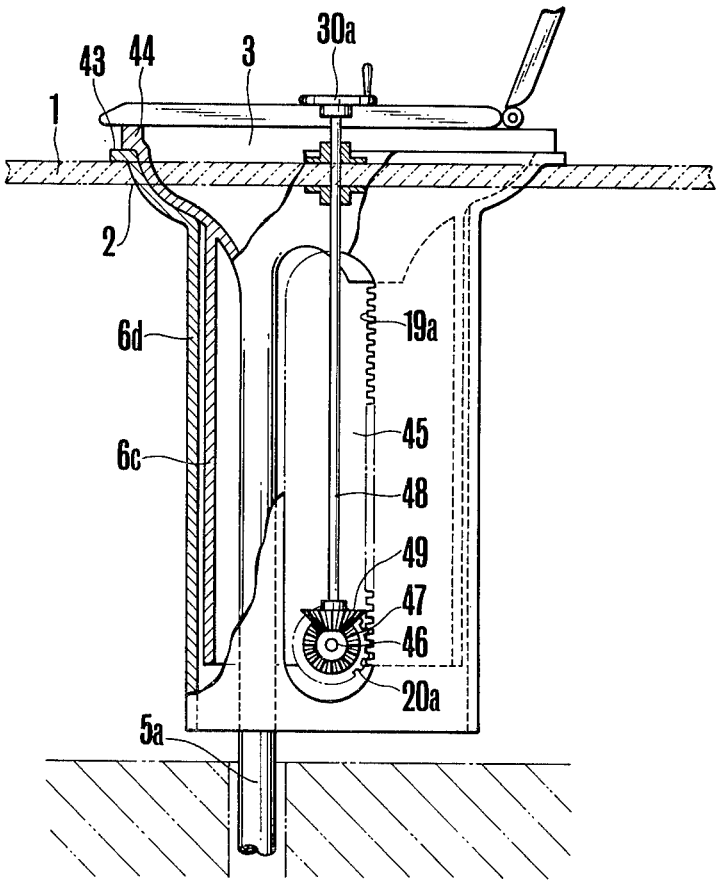
FIG. 6 is a partial sectional side view of a still further embodiment of the invention.
Figure 7:
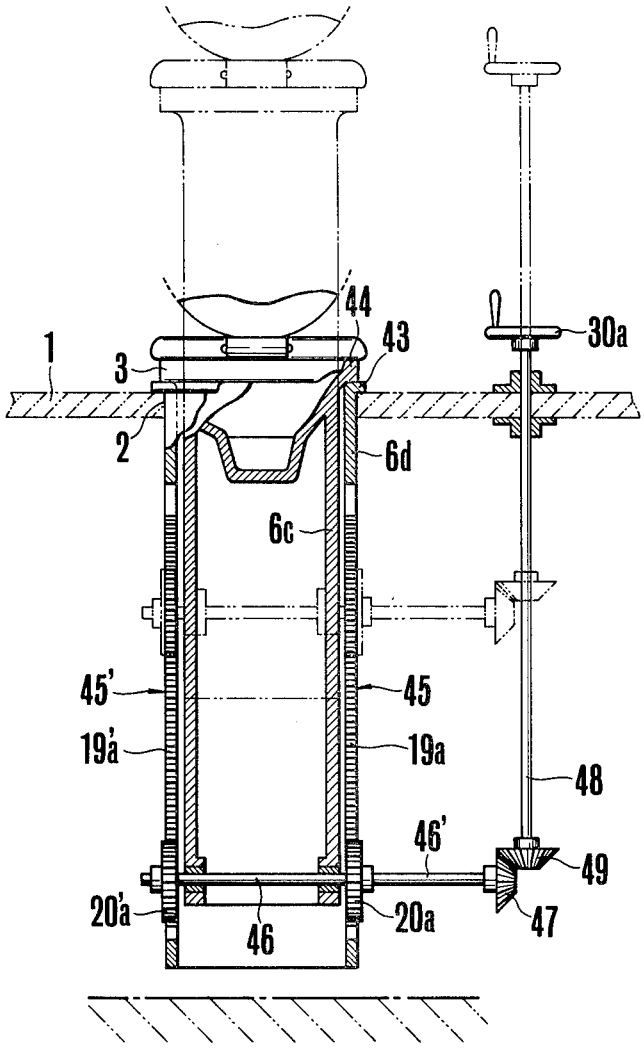
FIG. 7 is a partial sectional rear elevational view of the water closet shown in FIG. 6.

The embodiment of the present invention will now be described with reference to FIGS. 6 and 7. The water closet or toilet of FIGS. 6 and 7 has a floor or support member 1 with a hole 2. A drum 6d forms a part of the support member, and acts as an outer cylinder or tubular member, having an outwardly extending flange 43 formed integrally with the upper edge thereof. The outer drum 6d is fitted in hole 2 from above, and is fixed to floor 1 by fastening flange 43 to floor 1 around the periphery of hole 2 from above. A drum or tubular portion 6c, which acts as an inner cylinder and is a part of the stool member, includes the integrally formed stool or seat portion 3. Inner drum 6c is vertically movable in outer drum 6d. Stool 3 has, at its periphery, an outwardly extending flange 44 integrally formed therewith and adapted to engage with the top edge of the outer drum 6d.

On its opposite sidewalls, outer drum 6d has longitudinally extending elongated holes or slots 45 and 45' which have internal racks 19a and 19a' of the same pitch, along on side edge thereof. A horizontal shaft 46 is rotatably supported near the bottom of the opposite sidewalls of inner drum 6c, and both ends of shaft 46 extend through elongated holes or slots 45 and 45', respectively. Pinions 20a and 20a' mesh with respective racks 19a and 19a' and are connected to the projected ends of horizontal shaft 46. Horizontal shaft 46 includes an extension 46' at its one end to which a bevel gear 47 is fixed.

A vertical shaft 48 is rotatably and vertically movably mounted on the floor in the vicinity of hole 2. Vertical shaft 48 is provided with a bevel gear 49 adjacent the bottom end thereof. Bevel gear 49 meshes with bevel gear 47 and shaft 48 and includes a hand wheel 30a attached adjacent the top thereof. The stool 3 may thus be vertically moved by rotating the hand wheel clockwise or counterclockwise.

Figure 8:
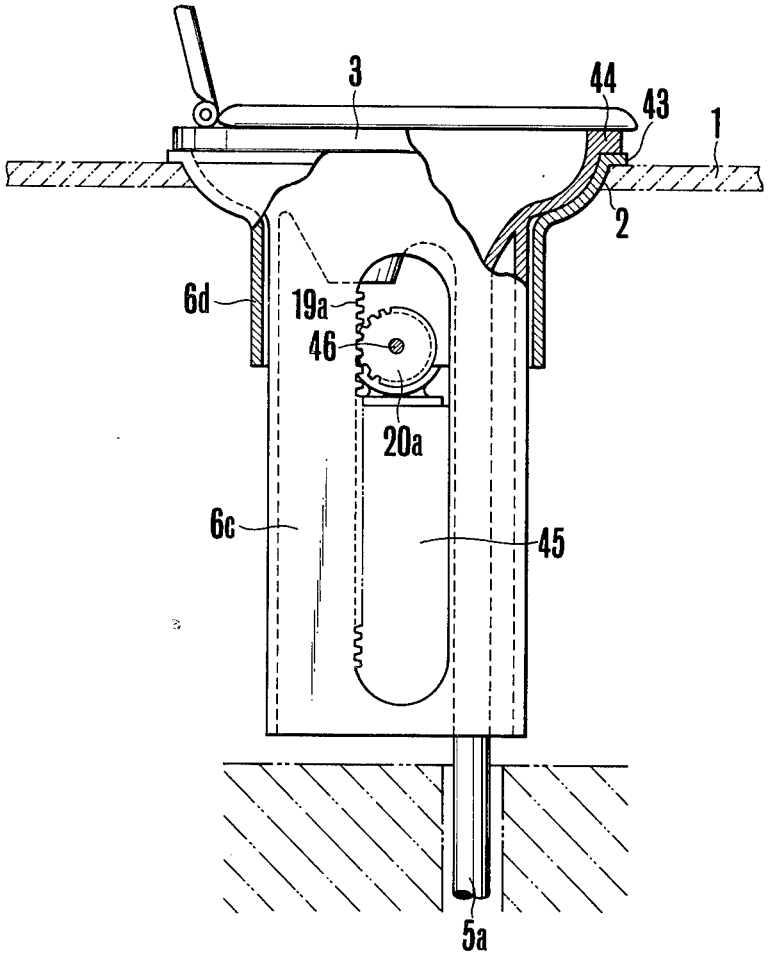
FIG. 8 is a partial sectional side view of a water closet according to another embodiment of the invention.
Figure 9:
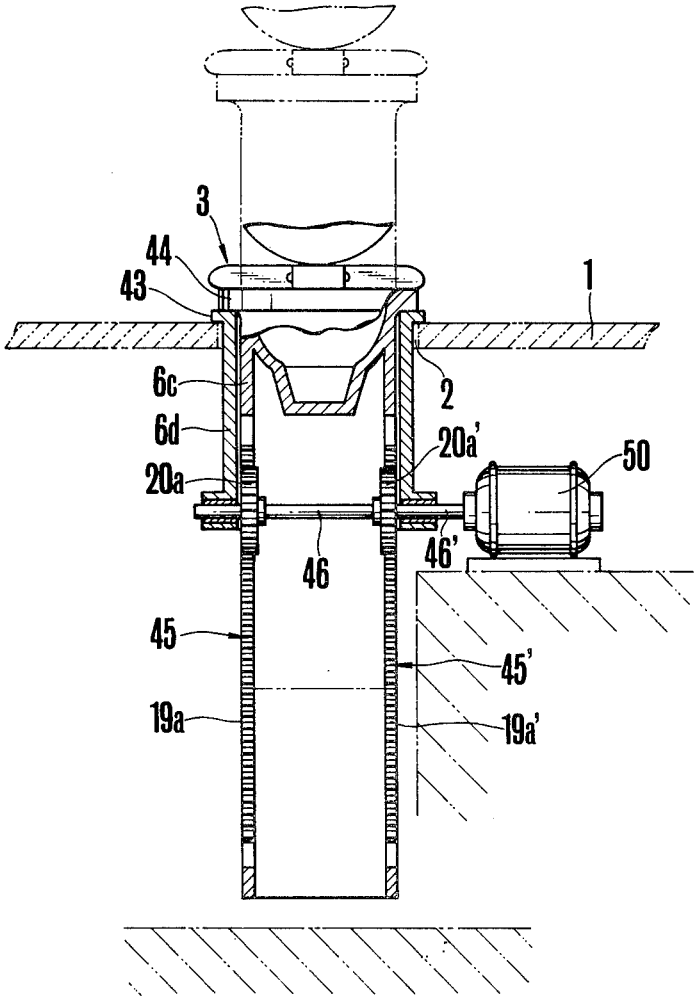
FIG. 9 is a partial sectional rear elevational view of the water closet shown in FIG. 8.

Another embodiment of the invention is described with reference to FIGS. 8 and 9. In the embodiment shown in FIGS. 8 and 9, inner drum 6c and outer drum 6d are provided in the same manner as shown in the embodiment of FIGS. 6 and 7. Inner drum 6c has longitudinal elongated holes or slots 45 and 45' on its opposite sidewalls, which have racks 19a and 19a' of the same pitch at one interior edge thereof. A horizontal shaft 46 is inserted through elongated holes 45 and 45'. Both ends of horizontal shaft 46 are rotatably supported adjacent the bottom of opposite sidewalls of outer drum 6d. Pinions 20 and 20a' are provided to engage racks 19a and 19a', respectively. Pinions 20a and 20a' are fixed to horizontal shaft 46 at appropriate locations. Horizontal shaft 46 includes an extension 46' at one end thereof which is coupled to a motor 50. The height of the stool 3 may be changed by rotating motor 50 clockwise or counterclockwise by suitable controls, which have not been shown.

Figure 10:
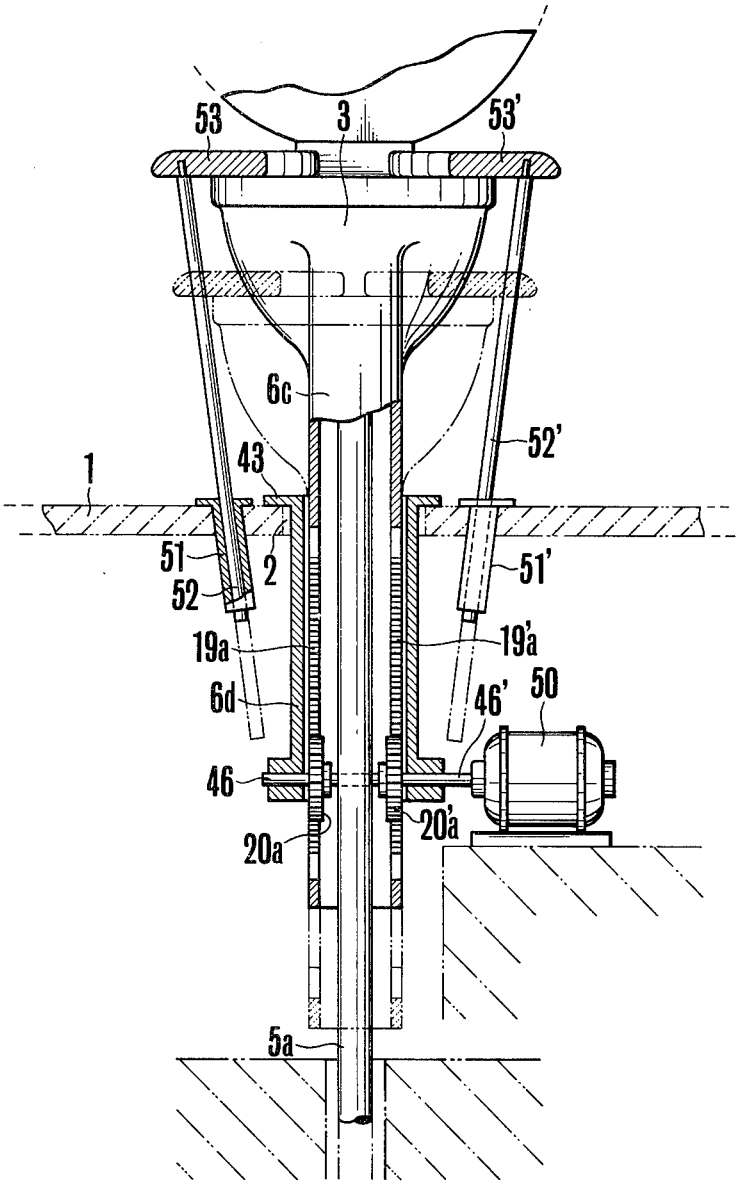
FIG. 10 is a partial sectional elevational view of the water closet according to another embodiment of the invention.
Figure 11:
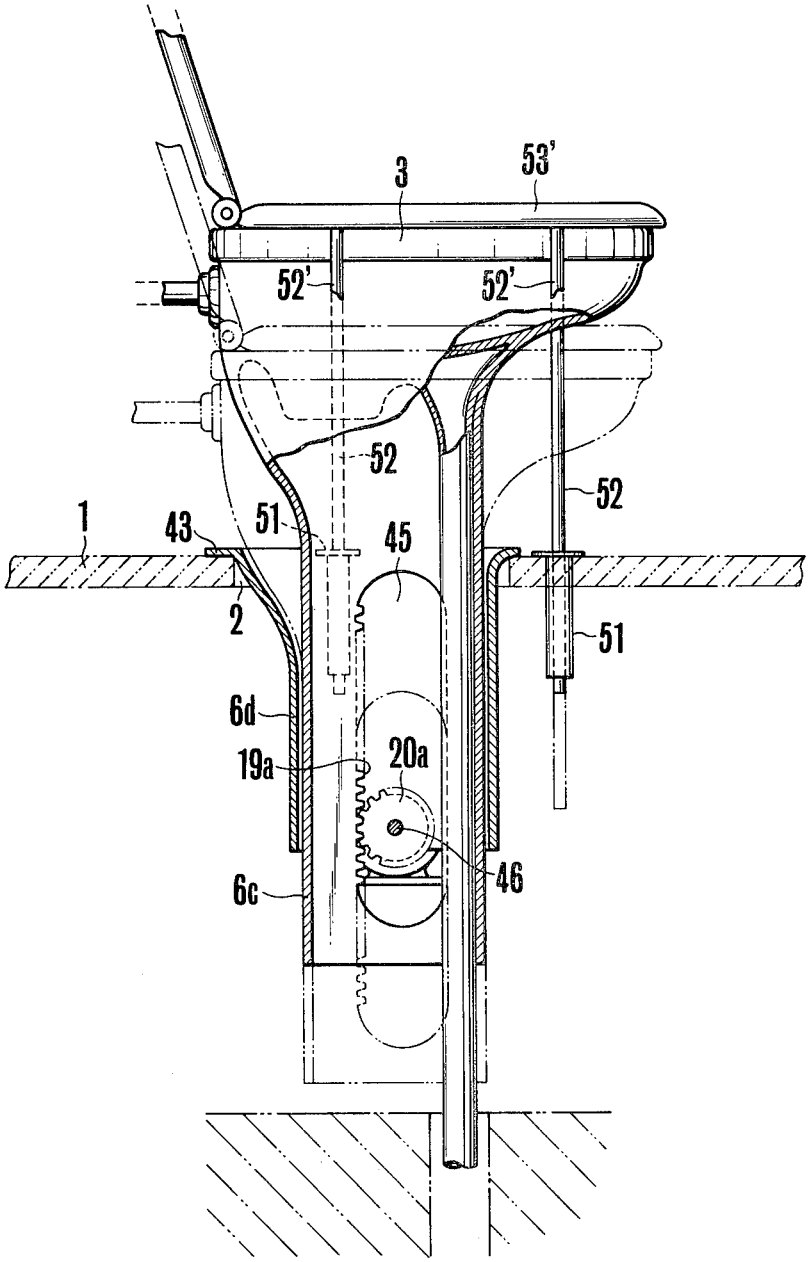
FIG. 11 is a partial sectional side view of the water closet shown in FIG. 10.
Figure 12:
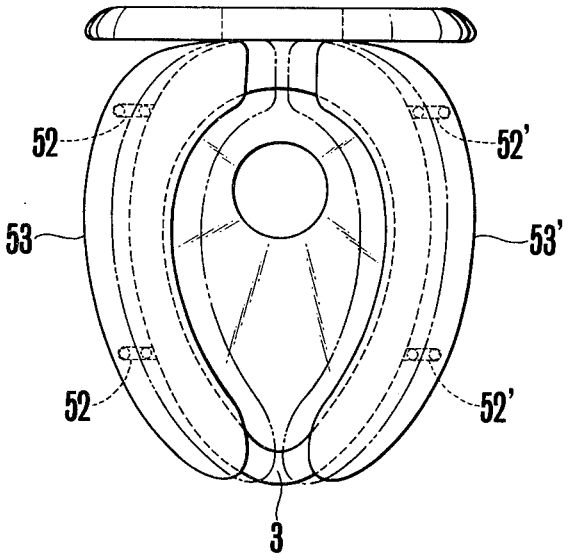
FIG. 12 is a two-positioned plan view of the water closet shown in FIG. 10.

Another embodiment of the invention is described as follows with reference to FIGS. 10 to 12. In this embodiment, the width of the seat on the stool can be changed by an interlocking means to the above-mentioned stool height-adjusting means. The stool height-adjusting means is formed in the same manner as in the case of the embodiment shown in FIGS. 8 and 9.

Two pair of short guide pipes 51 and 51' are fixed in floor 1 at respective sides of stool 3 so that they are inclined slightly outwardly from a vertical line. Two pair of base rods 52 and 52' are slidably mounted in the short pipes 51 and 51', respectively, so that they may be moved along the axis of short pipes 51 and 51'. A set of two arc-shaped closet seat members or arcuate portions 53 and 53' are laterally slidable on stool 3. Closet seat members 53 and 53' are fixed to the top ends of base rods 52 and 52', respectively. In operation, the height of the stool or closet seat is changed when motor 50 is rotated clockwise or counterclockwise. When the height of the stool is increased, base rods 52 and 52' are moved while guided by short pipes 51 and 51', and therefore, the width of the closet seat comprising members 53 and 53' are gradually increased. On the other hand, the width of the closet seat is gradually decreased when the stool is lowered. An adult can therefore use the water closet while keeping the stool 3 high, and thus the closet seat wide and, similarly, a child can use the water closet while maintaning a low height of stool 3 and thus the closet seat narrow. Thus, besides the height of stool 3, the width of closet seat 53 and 53' may also be easily adjusted by actuating motor 50.

Figure 13:
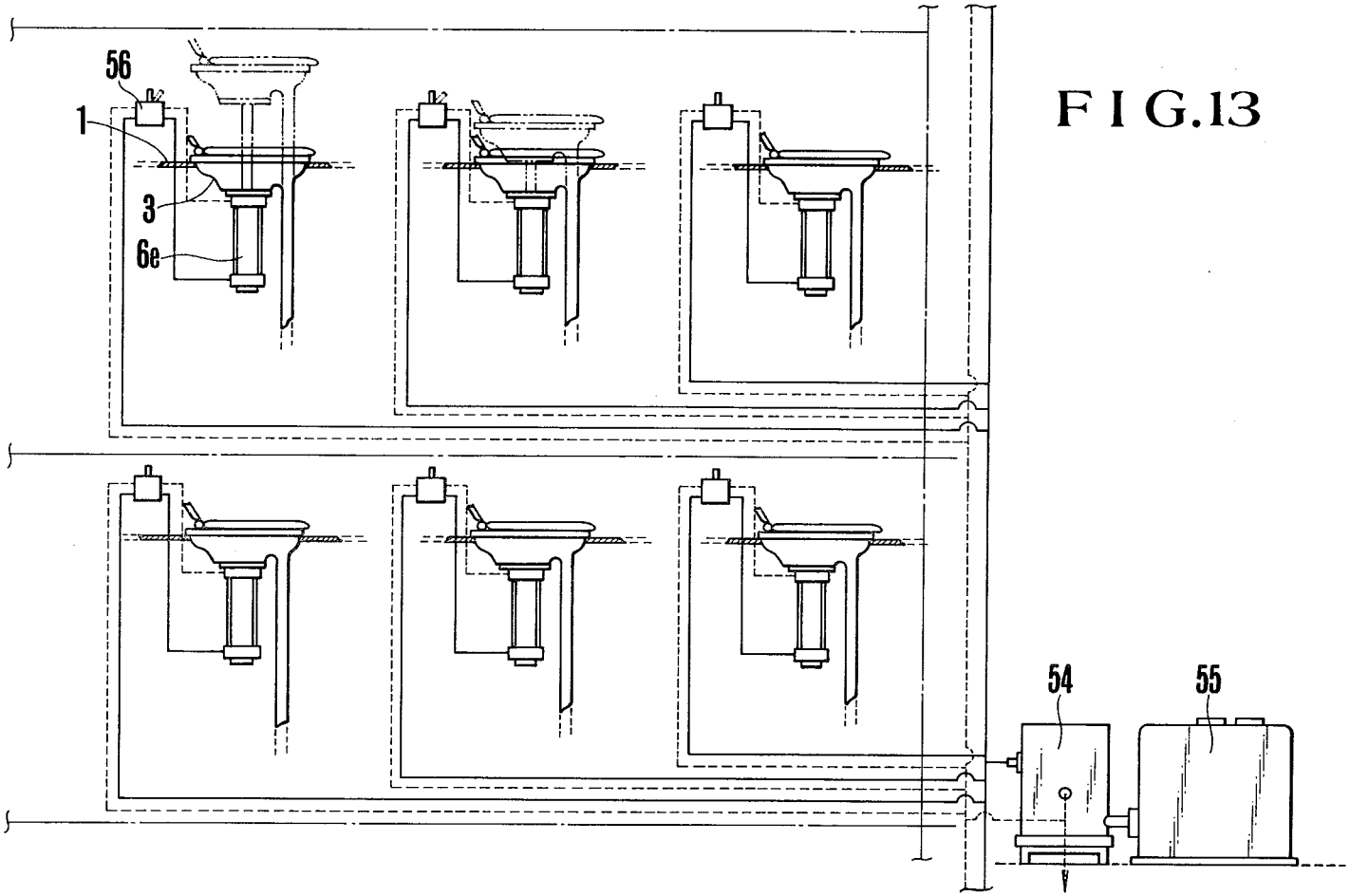
FIG. 13 is a schematic piping diagram of a water closet contructed in accordance with another embodiment of the invention.

A still further embodiment of the present invention is described with reference to FIG. 13. In the embodiment of FIG. 13, a plurality of stools in water closets are provided in a multi-storied building or the like, and they may be individually adjusted in height. In FIG. 13, a plurality of stools 3 are vertically movably provided on the floor 1 of each story in the same manner as in the case of the embodiments mentioned hereinbefore. An air cylinder 6e, which corresponds to the drum in each of the embodiments of FIGS. 1 through 12, is fixed to each stool 3 so as to vertically move the stool. A compressor 54 is provided to supply air to the air cylinder 6e and a vacuum pump 55 is provided for extracting air from air cylinder 6e. In addition, a manual cock 56 is provided in the vicinity of each stool 3 in order to achieve the switchover from the air supply operation to the air extracting operation, or vice versa. Each stool 3 may thus be independently elevated or lowered by controlling the manual cock 56.

In accordance with the present invention, a hydraulic cylinder and pump arrangement may be substituted for the air cylinder arrangement described above, and further may be substituted for the various drive means hereinbefore described.

While specific embodiments of the invention have been shown and described in detail to illustrate the application of the principles of the invention, it will be understood that the invention may be embodied otherwise without departing from such principles.

What is claimed is:

1. A toilet for human waste, adjustably positionable on a support at floor level comprising:

an outer tubular drum member connected to the support and extending downwardly therefrom;

a stool member supported on said outer drum including a seat and bowl portion and a tubular drum portion extending downwardly from said bowl portion, said drum portion comprising an inner drum member concentrically slidable in said outer drum member;

said outer drum member including at least one elongated slot therein having an internal vertical rack formed along one elongated edge thereof;

a shaft rotatably mounted on said inner drum member;

a pinion connected to said shaft and engaged with said rack; and drive means connected to said shaft for rotating said pinion and moving said inner drum member upwardly and downwardly with respect to said outer drum member.

2. A toilet according to claim 1, wherein said drive means comprises a first bevel gear connected to said shaft, a second bevel gear engaged with said first bevel gear, a second shaft connected to said second bevel gear and rotatably and axially displaceably mounted in the support, and a handwheel connected to said second shaft adapted to be rotated for rotating said pinion.

3. A toilet according to claim 1, wherein said outer member further includes a second elongated slot on a side of said outer member opposite from said first mentioned elongated slot including a second internal vertical rack formed along one elongated edge thereof; a second pinion connected to said shaft and engaged with said second rack.

4. A toilet for human waste adjustably positionable on a support at floor level comprising:

an outer tubular drum member connected to the support and extending downwardly therefrom;

a stool member supported on said outer drum including a seat and bowl portion and a tubular drum portion extending downwardly from said bowl portion, said drum portion comprising an inner drum member concentrically slidable in said outer drum member;

said inner drum member including at least one elongated slot therein having an internal vertical rack formed along one elongated edge thereof;

a shaft rotatably mounted on said outer drum member;

a pinion connected to said shaft and engaged with said rack; and drive means connected to said shaft for rotating said pinion and moving said inner drum member upwardly and downwardly with respect to said outer drum member.

5. A toilet according to claim 4, wherein said drive means comprises a motor connected to said shaft for rotating said pinion.

6. A toilet according to claim 4, wherein said inner drum member includes a second elongated slot on the side of said inner drive member opposite from said first-mentioned elongated slot with an internal vertical rack formed along one elongated edge thereof, and a second pinion connected to said shaft engaged with said second rack.

* * * * *